US007797905B1

(12) United States Patent
Smalley

(10) Patent No.: US 7,797,905 B1
(45) Date of Patent: Sep. 21, 2010

(54) ROOFING SYSTEM AND MEMBERS

(75) Inventor: David L. Smalley, 4874 Cowan Rd., Acworth, GA (US) 30101

(73) Assignee: David L. Smalley, Acworth, GA (US)

( * ) Notice: Subject to any disclaimer, the term of this patent is extended or adjusted under 35 U.S.C. 154(b) by 162 days.

(21) Appl. No.: 12/034,006

(22) Filed: Feb. 20, 2008

Related U.S. Application Data

(60) Provisional application No. 60/891,627, filed on Feb. 26, 2007.

(51) Int. Cl.
*E04B 7/02* (2006.01)
*E04B 9/00* (2006.01)
*E04B 7/08* (2006.01)

(52) U.S. Cl. ..... 52/643; 52/478; 52/90.1

(58) Field of Classification Search ..... 52/478, 52/90.1, 92.1, 92.2, 92.3, 96, 639, 643, 696, 52/634

See application file for complete search history.

(56) References Cited

U.S. PATENT DOCUMENTS 395,306 A * 1/1889 Andre ..... 52/478
2,150,217 A * 3/1939 Gettelman ..... 52/72
2,720,290 A * 10/1955 Henrickson ..... 52/506.06
3,064,772 A * 11/1962 Clay ..... 52/479
3,242,622 A * 3/1966 Snead ..... 52/94
3,950,903 A * 4/1976 Lerch et al. ..... 52/92.2
4,128,984 A * 12/1978 Charbonneau et al. ... 52/746.11
4,408,423 A * 10/1983 Lautensleger et al. ..... 52/90.1
4,455,792 A * 6/1984 Pasco ..... 52/93.2
5,224,308 A * 7/1993 Trumbull ..... 52/94
5,384,993 A * 1/1995 Phillips ..... 52/92.2
5,577,353 A * 11/1996 Simpson ..... 52/92.2
5,743,063 A * 4/1998 Boozer ..... 52/713
5,911,663 A * 6/1999 Eidson ..... 52/520
6,092,340 A * 7/2000 Simmons ..... 52/92.1
6,401,412 B1 * 6/2002 Cooper ..... 52/302.1
7,174,686 B1 * 2/2007 Legband ..... 52/471
7,325,362 B1 * 2/2008 Rowland ..... 52/93.2
2005/0011142 A1 * 1/2005 Higgins ..... 52/90.1

FOREIGN PATENT DOCUMENTS

GB 2228024 A * 8/1990

* cited by examiner

*Primary Examiner*—Richard E. Chilcot, Jr.
*Assistant Examiner*—Ryan D Kwiecinski

(57) ABSTRACT

The disclosure is directed to a roofing assembly. The roofing assembly can include trusses, purlins, and purlin collars. Purlins can be attached to the trusses, and purlin collars can be attached to the trusses, to the purlins, or both. The purlins and purlin collars can be attached using chemical and/or mechanical fasteners. In one embodiment, the purlins and purlin collars are attached to the trusses with nails. Another embodiment of the disclosure includes an integrated starter-terminator that includes a hat section, a fascia, and a soffit return. The starter-terminator can be attached to the purlins, the purlin collars, or both, and can be attached to the roofing system using any desired attachment mechanisms, including nails.

7 Claims, 10 Drawing Sheets

ROOFING SYSTEM AND MEMBERS

RELATED APPLICATION

This application claims priority to U.S. Provisional Patent Application Ser. No. 60/891,627, filed Feb. 26, 2007, the entirety of which is hereby incorporated by reference.

TECHNICAL FIELD

This disclosure relates to building construction. More specifically, the present disclosure relates to improved light gauge steel roofing systems.

BACKGROUND

In a typical roofing system, metal or wood trusses are used to support a roof assembly. Such trusses typically include a variety of support members including a top chord supported at an angle by a plurality of web members extending from a bottom chord. A plurality of trusses can be placed atop a building frame in a parallel spaced apart arrangement such that the slope of the top chords defines the pitch of a roof.

Additional support members, referred to as purlins, are sometimes incorporated atop the truss top chords in a spaced apart parallel arrangement and in a direction perpendicular to the top chords. Such purlins typically help support the downward vertical loads of a heavy roof assembly, such as barrel roof tiles, and help provide ventilation. Prior art purlins include dimensional lumber and formed sheet metal with right angle bends having Z, C, S, or top hat-shaped cross sections that include a generally vertical web located between top and bottom legs (used for attaching the purlin to rafters and roof panels).

Such roofing systems are designed to meet certain performance requirements, such as vertical resistance to dead loads as required under local building codes. Such performance depends upon a variety of factors, including the type, thickness, and spacing of the trusses, and roof panels, as well as the type and placement of fasteners used. Such performance is measured by a variety of organizations that test roof assemblies.

The installation of typical roofing systems is labor intensive. In a typical construction, the purlins are attached to the top chords and roof panels by screw fasteners. While such screw fastening techniques are suitable for their intended purpose and result in acceptable performance, when correctly applied, the use of screw fasteners is time consuming when compared to installations using nail fasteners, which can be quickly installed by auto-nailers such as pneumatic nail guns. This is especially evident when considering the number of fasteners required for large roofing jobs can require the installation of more than sixty-eight (68) fasteners per four by eight foot (4'×8') roof panel. Further, it is a common problem that when screw fasteners are over-applied they drill out the metal framing members intended to be connected, thereby rendering the connection inadequate.

In addition to the installation of the trusses and roof panels, a fascia and soffit are commonly attached to the truss heel. In the prior art, the starter-terminator purlin, fascia, and soffit are separate pieces installed separately at the eave. For example, a starter-terminator purlin can be installed by one worker, a fascia by another worker at another time, and the soffit by still another worker at another time. Installing each of these structures separately is time consuming and inevitably leads to one worker getting in the way of another and requires separate set up for each installation. Furthermore, it can be difficult to make a water resistant, if not waterproof, seal between these separate pieces.

SUMMARY

The present disclosure provides a light gauge steel purlin of certain configurations that allows for the use of nail fasteners to fasten the purlin to a light gauge steel roof truss and plywood roof panels to the purlin in a manner that provides excellent wind-uplift performance. Further, the disclosure provides a light gauge steel purlin collar and method of securing the purlin collar to the truss and purlin that measurably improves the wind uplift performance.

In an exemplary embodiment, the purlin is of top hat cross section and made of light gauge steel having four bends that define a generally horizontal hat top, generally angled webs, and generally horizontal legs. In other embodiments the trusses, purlins, and purlin collars include composite materials with performance criteria that meet or exceed those of light gauge steel, and the roof panels include composite materials with performance criteria that meet or exceed those of APA approved structural panels. In other embodiments the trusses or purlins are wood.

In one embodiment the hat top and legs are of a size that allows for the spaced attachment of square-edged roofing panels atop the purlin, and the purlins to a truss top chord, using pin fasteners. In an alternative embodiment the top and legs are of a size that allows for the connection of tongue and groove roofing panels.

The present disclosure also provides an arrangement of trusses, purlins, purlin collars, and roof panels wherein pin or nail fasteners can be installed with auto-nailers, and which provides excellent wind-uplift performance. The term "fastener", in the singular or plural, include all manner of nails, pins, screws, tacks, rivets, bolts, welds, all mechanical, electro-mechanical, and chemical-mechanical attachments, combinations thereof, and the like. The terms "pin" or "nail", in the singular or plural, include a fastener that can be driven or shot directly into the materials, such as with a hammer or nail gun, and need not be twisted as a screw-driver or screw gun does with a screw. In an exemplary embodiment heat treated ballistic point steel pins with a grip knurled shank are used. In an efficient embodiment automatic-nailers are used, such as pneumatic nailers with adjustable depth control.

The present disclosure also provides an arrangement of light gauge steel trusses, purlins, and purlin collars wherein adhesive can be applied to provide excellent wind uplift performance.

The present disclosure further describes an integrated starter-terminator comprising a hat section, fascia, and soffit return that can be installed as a single unit. In an exemplary embodiment, the integrated starter-terminator is formed from a single panel of light gauge steel having six bends. A hat section can be defined by the portion of the steel panel between a first edge and a fifth bend and include four bends which define two legs, two webs, and a top section similar. The legs can be placed in the same plane parallel to the plane of the top. The hat section can be integrated with a fascia, defined by the portion of the integrated starter-terminator between a fifth and sixth bend. The fifth bend can define the angle between the legs of the hat section and the fascia. This angle can be arranged to match the angle defined between the heel truss and the top chords of the trusses. A soffit return can be defined by the section between a sixth bend and a second edge and can generally be sloped in a horizontal direction back toward the building to which it is installed. The soffit return can include the entire soffit sheathing attached to the outlookers or truss bottom chords, or can be used in conjunction with a soffit assembly to form the soffit sheathing.

Thus, in an exemplary embodiment a hat section is integrated with a fascia and positioned at an angle similar to the slope of the roof to which the unit will be attached; the fascia will fit flat against the heel truss and the soffit will return to the building at whatever angle is required by the designer or architect. Further, the integrated starter-terminator can be installed in one step thereby eliminating the need of separate installations of end blocking between the heels of the trusses, a starter-terminator purlin, fascia board, and soffit return. Of course the angle of the hat section as well as the sizes of particular sections of the integrated starter-terminator can vary according to the particular application. For example, the size of the fascia can vary with the size of the truss heel to which it will be attached.

The present disclosure also provides an above the top chord roofing system which can incorporate one or more of the aforementioned purlin, purlin collar, nail or pin fasteners, adhesive, and integrated starter-terminator. In an exemplary embodiment a plurality of trusses are spaced in a predetermined parallel arrangement. A plurality of purlins are fastened to the truss top chords in a predetermined spaced apart arrangement using nail or pin fasteners. Purlin collars are secured to the truss and purlin with adhesive and further fastened to the truss using nail or pin fasteners. Roofing panels of predetermined size are positioned and fastened to the purlin tops using a predetermined fastener pattern. The integrated starter-terminator purlin, fascia, soffit can also be used. In an exemplary embodiment, the trusses are arranged 48 inches on center, the hat sections 24 inches on center, and the roof panels are four feet by eight feet by three quarter inch (4'×8'×¾") structural panels.

The present disclosure further provides a faster and safer method of installing a roof system. After a sufficient number of trusses are erected, at least one starter-terminator is installed. Measuring from the inward facing leg of the starter-terminator, the installer identifies and marks the position of the first row of purlins. In some embodiments the purlin collars are then also attached. With a sufficient length of starter-terminator and purlins attached, the installers then attach a first row section of structural panels. With a sufficient area of first row structural panels attached, the installers have a surface area by which they can safely install successive rows of purlins and rows of structural panels.

DESCRIPTION

As required, detailed embodiments of the present disclosure are disclosed herein. It must be understood that the disclosed embodiments are merely exemplary and can be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Figure 1:
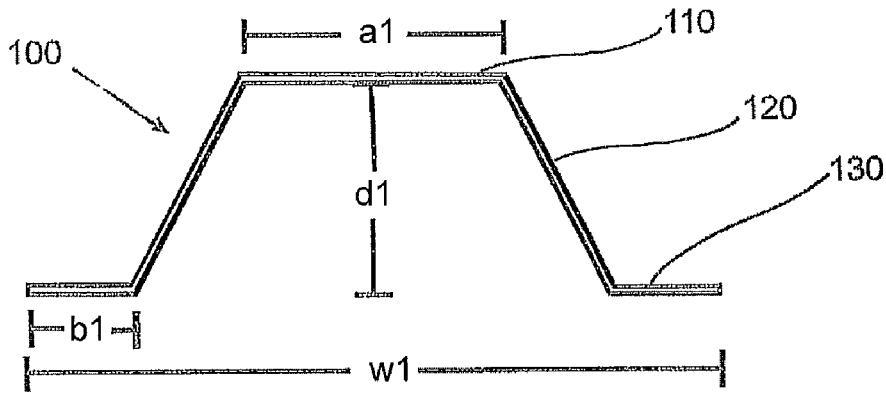
FIG. 1 is a cross-section view of a top hat purlin in accordance with an embodiment of the present disclosure.
Figure 2:
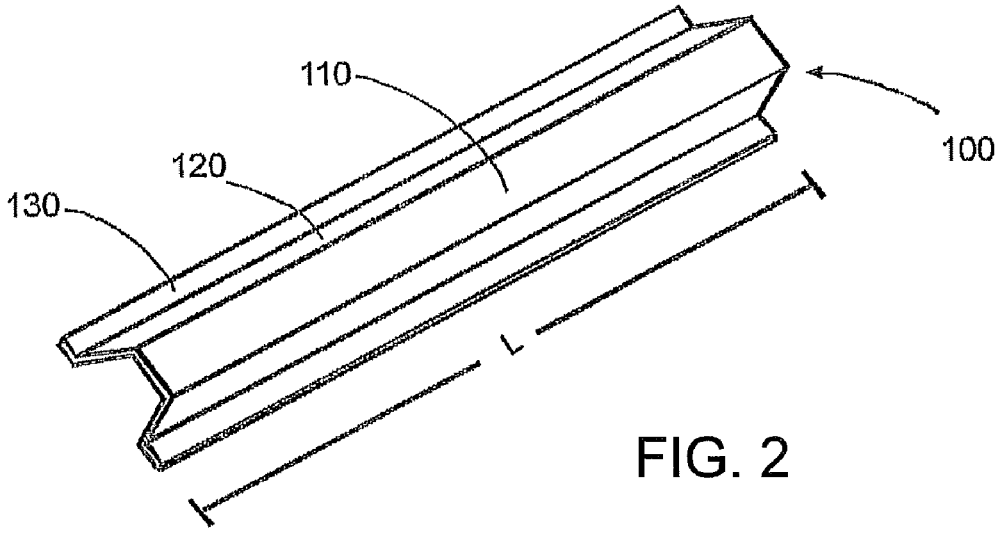
FIG. 2 is a perspective view of a top hat purlin in accordance with an embodiment of the present disclosure.

Referring to the drawings, wherein like elements are designated by like numbers throughout, FIGS. 1 and 2 illustrate a purlin 100 according to an exemplary embodiment of the present disclosure. The illustrated purlin 100 has what is sometimes referred to as top-hat cross section, having a generally horizontal top 110 supported by generally vertical webs 120 and generally horizontal legs 130. In the illustrated exemplary embodiment, the purlin 100 is made of 18 gauge cold formed steel with a G60 galvanized surface and bent formed through four bends into a desired cross section having a top of width "a1" of about one and three-quarter inches (1¾"), a depth "d1" of about one and a half inches (1½"), legs 130 having a width "b1" of about three quarters of an inch (¾"), and a total purlin cross sectional width "w1" of about four and three quarter inches (4¾").

The width "a1" of the top 110 can include sufficient surface area for securing roofing panels, such as plywood or OSB structural panels, to the purlin 100. In the exemplary embodiment, the width is sufficient to accommodate two rows of nail fasteners, one row for each panel edge. The length "L" of the purlin 100 can be any dimension, typically determined based upon the intended use, one example being sixteen feet and six inches (16'6") in an application wherein the purlins 100 are fastened to trusses arranged about forty-eight inches (48") apart, on center, as discussed more fully below. The height "d1" of the purlin 100 can also be determined by the intended use, one design criterion being the depth necessary to install rigid or batt insulation between the top chord of the truss and the roof panel. Similarly, if a barrier is placed between the top chord and the purlin 100, such as a plastic vapor barrier, the height "d1" of the purlin 100 can determine the amount of ventilation available under various conditions.

The purlin 100 can be attached to a truss top chord by fasteners through the legs 130. Applicant has found that inexpensive light gauge steel can effectively meet wind uplift requirements when formed and used with fasteners as discussed more fully below. However, characteristics and dimensions of the purlin 100, including material, gauge, and finish can vary depending upon the particular application without departing from the scope of the claims. For example, in other embodiments the trusses, purlins, and purlin collars can include composite materials with performance criteria that meet or exceed those of light gauge steel, and the roof panels can include composite materials with performance criteria that meet or exceed those of American Plywood Association (APA) approved structural panels.

Figure 3:
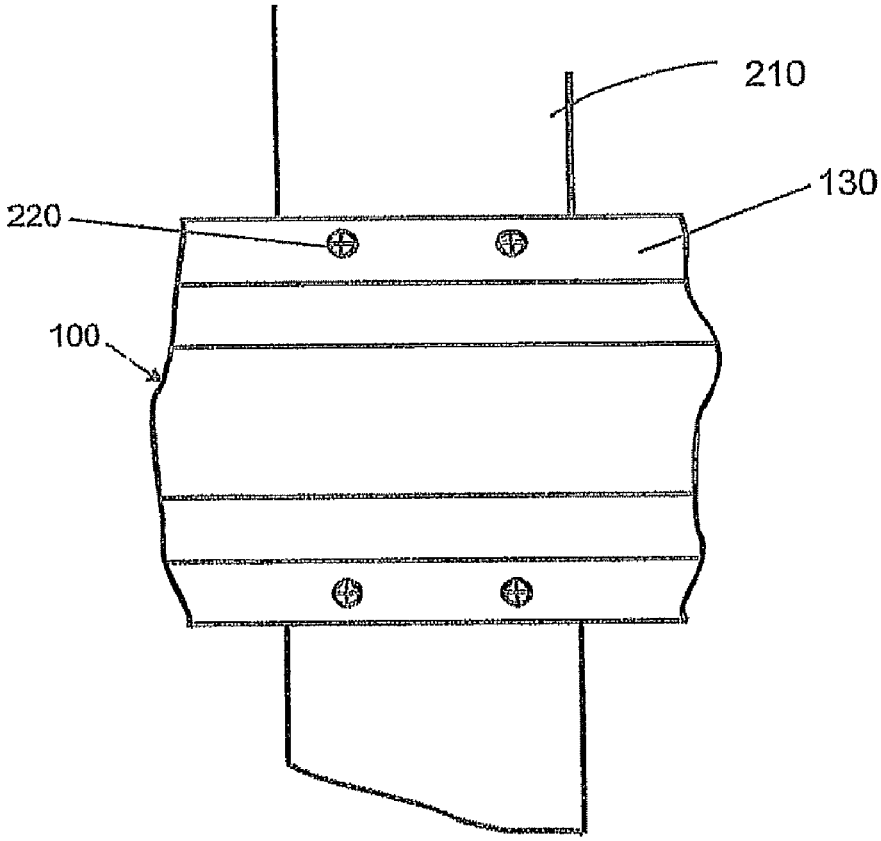
FIG. 3 is a plan view of the top hat purlin of FIG. 1 fastened to a truss top chord in accordance with an embodiment of the present disclosure.
Figure 4:
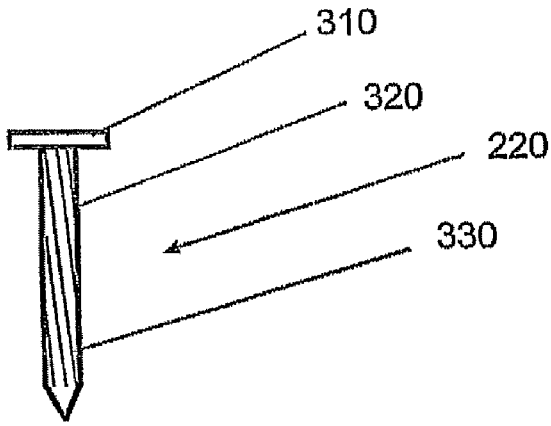
FIG. 4 is a side elevation view of an embodiment of a fastener in accordance with an embodiment of the present disclosure.

As shown in FIG. 3, the metal purlin 100 can be fastened to a metal truss top chord 210 with pneumatically applied nails 220. In the illustrated embodiment, the truss top chord 210 and the purlin 100 are made from light gauge steel, providing a metal to metal connection. In other embodiments a vapor barrier or other building material that does not reduce the uplift strength of the fasteners in the metal to metal connection can be placed between the top chord 210 and the purlin 100. Nails 220, best shown in FIG. 4, can be heat treated ballistic point steel pins 220 having a head 310 of about one quarter of an inch (¼") in diameter and a shank 320 of about three quarters of an inch (¾") in length, about one tenth of an inch (0.100") in diameter, and with a grip knurl pattern 330. One example of such fasteners is sold under the name GRIP-SHANK®.

Preferably an auto-nailer such as a pneumatic nailer with adjustable depth control and auto-centering is used to drive the pins to a desired depth. The Applicant has determined that the use of the nails reduces installation time as well as worker fatigue and eliminates the cost of broken drill bits while providing a roof with excellent wind-uplift performance. It is believed that the ballistic-shaped point uniformly pierces the steel such that the displaced steel rebounds around the pin to create a strong compressive force on the knurled pin shank to help prevent withdrawal of the pin. Of course other sized nail or pin fasteners can be used, depending upon the particular materials being fastened and the design criteria, without departing from the scope of the claims.

At least one pin 220 can be included, near the location at which each purlin leg 130 rests atop each top chord 210, to secure the purlin 100 to the top chord 210. The illustrated legs 130 provide sufficient surface area to accommodate the fastening of a single nail 220 to attach the purlin 100 to the top chord 210. However, each leg 130 can be made wider to accommodate the placing of multiple pins 220 through each purlin leg 130. Such a design can help increase the uplift strength of the purlin 100 to top chord 210 connections. It will be understood by those skilled in the art that, depending upon design criteria, placement of the framing members, and the direction of the design professional, that not every purlin 100 must be connected to a top chord 210 of the truss on which the purlin 100 rests. Further, one or more purlins 100 can be configured to slip to allow for expansion and contraction of the system. Such slip can be provided at selected fastener locations.

Figure 5:
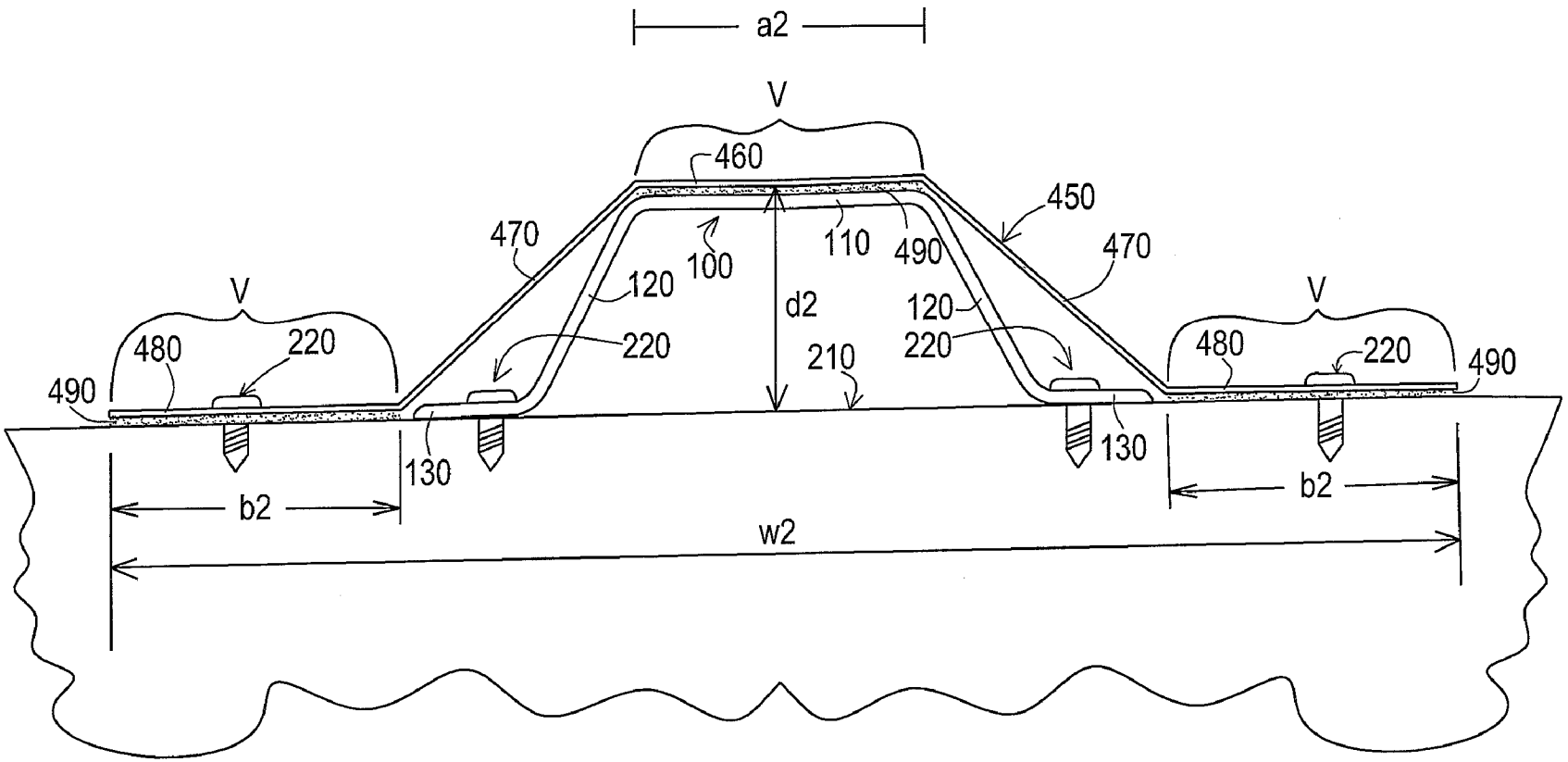
FIG. 5 is a cross-section view of an arrangement of the top hat purlin of FIG. 1, a purlin collar, and a truss top chord that are secured to one another in accordance with an embodiment of the present disclosure.

Referring to FIG. 5, a purlin collar 450 is secured over the purlin 100. It should be understood that a purlin collar 450 can provide a reinforced connection between a purlin 100 and a truss top chord 210. Specifically, the use of a purlin collar 450 in a roofing system can increase the wind uplift resistance performance of the roofing system. For example, the Applicant has found that the use of purlin collars 450 alone can increase the wind uplift resistance performance from about ninety (90) miles per hour to about one hundred thirty-five (135) miles per hour.

The exemplary purlin collar 450 has a top-hat cross section that is dimensioned with respect to the cross section of the purlin 100. The cross section of the purlin collar 450 includes a generally horizontal top 460 supported by generally angled webs 470 and generally horizontal legs 480. In the illustrated embodiment, the purlin collar 450 is made of 18 gauge cold formed steel with a G60 galvanized surface and bent formed through four bends into a desired cross section having a top 460 of width "a2", a depth of width "d2", legs 480 of width "b2" and a total purlin collar 450 of cross sectional width "w2". The width "a2" of the top 460 is substantially equal to the width "a" of the top 110 and the depth "d2" is substantially equal to the depth "d". However, it should be understood that, in the exemplary embodiment, the dimensions "a2" and "d2" of the purlin collar 450 are slightly greater than the dimensions "a" and "d" of the purlin 100 since the purlin collar 450 is dimensioned to be placed over the purlin 100. Further, the dimensions of the illustrated purlin collar 450 are selected such that, as the purlin collar 450 is placed over the purlin 100, the inside surface of the top 460 is in contact with the outside surface of the top 110 and the legs 480 are resting against the truss top chord 210 at a location outside of, and substantially coplanar with, the legs 130. It should be understood that one way to provide this arrangement is for the webs 470 to be at an angle with respect to adjacent webs 120. The length of the purlin 100 can be optimized to provide a selected amount of surface area to facilitate securing the purlin collar 450 to the purlin 100, and to the metal truss top chord 210, as described in further detail below.

The purlin collar 450 can be secured to a truss top chord 210 and to a purlin 100 to strengthen the connection between the truss top chord 210 and the purlin 100. Referring to FIG. 5, in the exemplary embodiment, adhesive 490 provides a first means for securing the top 460 of the purlin collar 450 to the top 110 of the purlin 100. Further, an adhesive 490 can provide an additional means for securing the legs 480 of the purlin collar 450 to the truss top chord 210. As used herein, the term "adhesive" is broadly defined and includes acrylic adhesives and structural acrylic adhesives and equivalents thereof. A general description of this class of adhesives is given, for example by "J. A. Graham, Chapter 9 in *Adhesives in Manufacturing*, ed. by G. L. Schneberger, Marcel Decker (1983)". An example of a structural acrylic adhesive is LOCTITE® H8600™. Such structural acrylic adhesives are sometimes used in structural bonding applications that require tensile, shear, and peel strength as well as impact, stress, and shock resistance. The structural acrylic adhesives are available in two major categories: two-step no-mix structural acrylics and two-part structural acrylics. It should be understood that, in alternative embodiments, any known chemical compound that provides a substantially similar or improved performance can be substituted for adhesive to chemically bond the elements of the roofing system described herein.

The purlin collar 450 can also be secured to the metal truss top chord 210 by pins 220 through the legs 480, as described above with respect to the fastening of the purlin 100 to the truss top chord 210.

Figure 6:
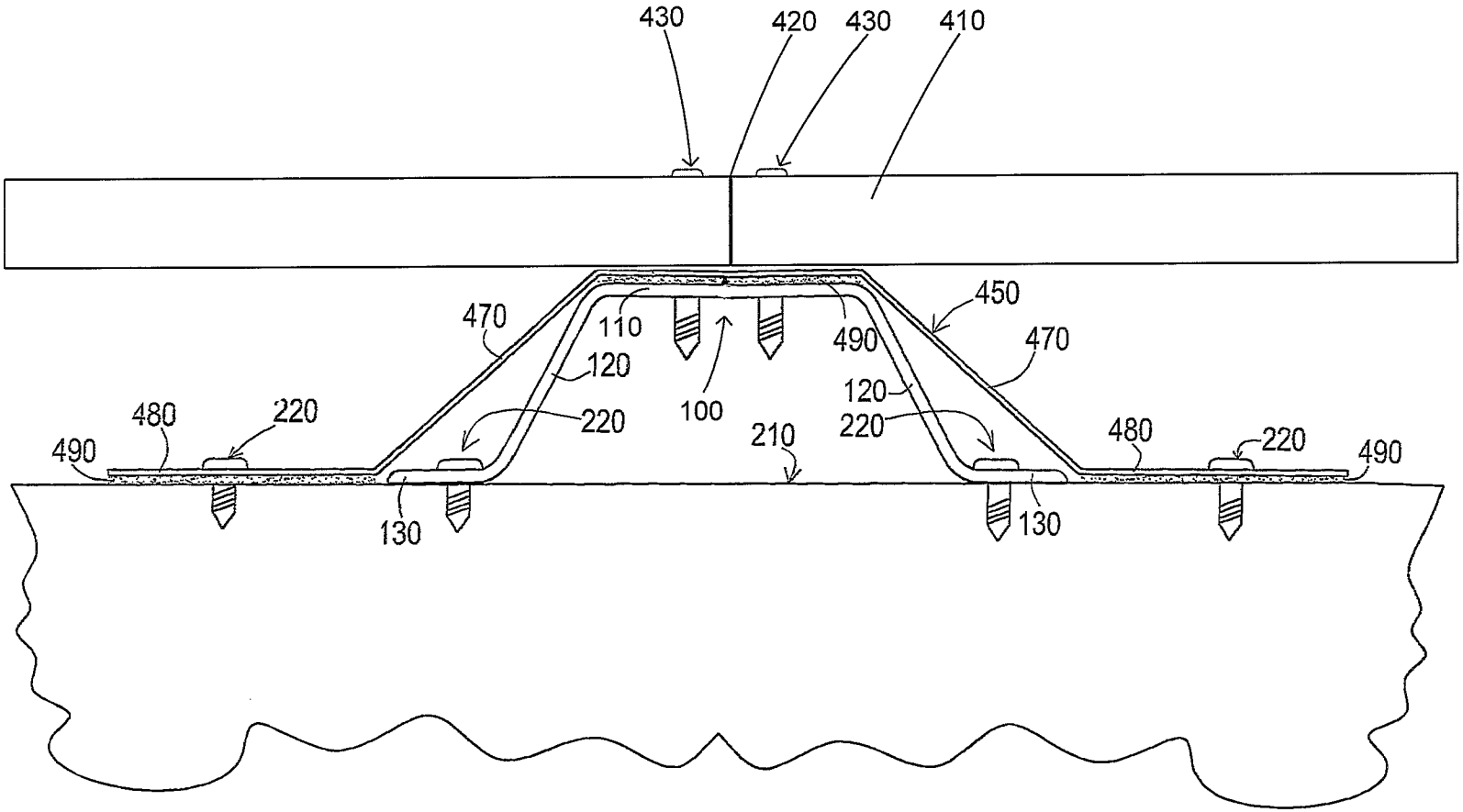
FIG. 6 is a cross-section view of roof panels applied over the top hat purlin and purlin collar of FIG. 5 in accordance with an embodiment of the present disclosure.

Referring now to FIG. 6, roof decking panels 410 can be fastened to the purlin 100 and/or the purlin collar 450. In the illustrated embodiment, three-quarter-inch (¾") thick plywood panels 410 having ends 420, can be attached to the purlin top 110 by one or more pins 430. The width of the illustrated purlin top 110 can allow for the spaced-connection of the roof panels 410. Other purlin top widths "a" can be lesser or greater depending up design criteria. The pins 430 can be similar to the pins 220. The pins 430 can optionally include a longer shank than the pins 220. The illustrated pins 430 can be heat treated ballistic point steel pins having a length of one and three eighths inches (1⅜") a one quarter inch (¼") head, and a one tenth of an inch (0.100") shank diameter with a grip knurl. One such type of pin is sold under the name GRIPSHANK®. By way of example and not limitation, the illustrated purlin top 110 has a one and three quarter inch (1¾") width. This width can allow a nail pattern of about one tenth of an inch (0.100") diameter nails located six inches (6") apart, on-center, and about three eighths of an inch (⅜") from the edge 420. Other nails and nail patterns can be selected according to other design criteria.

Figure 7:
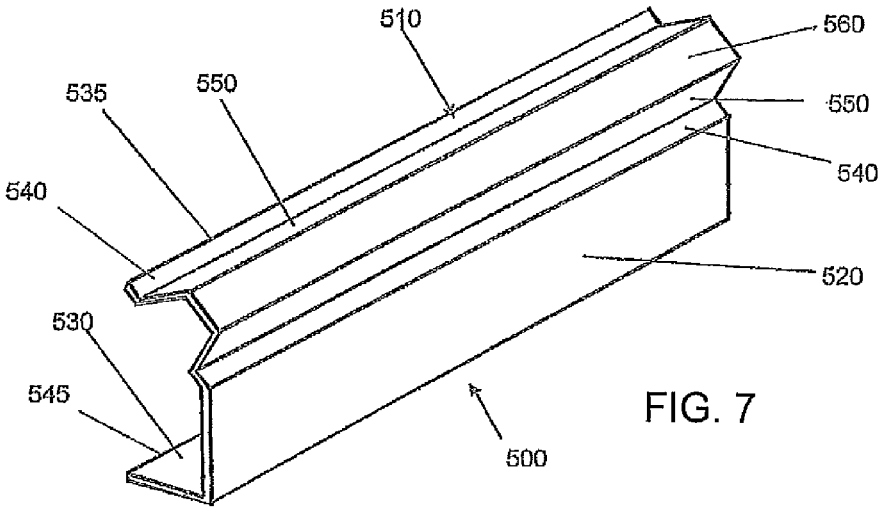
FIG. 7 is a perspective view of an integrated starter-terminator in accordance with an embodiment of the present disclosure.
Figure 8:
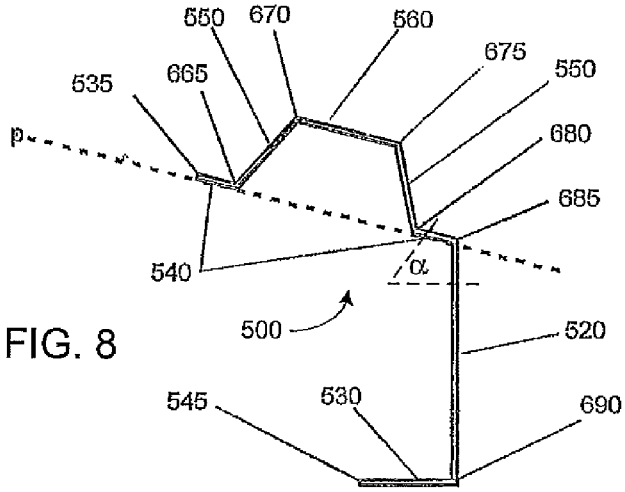
FIG. 8 is a cross-section view of an integrated starter-terminator in accordance with an embodiment of the present disclosure.
Figure 8A:
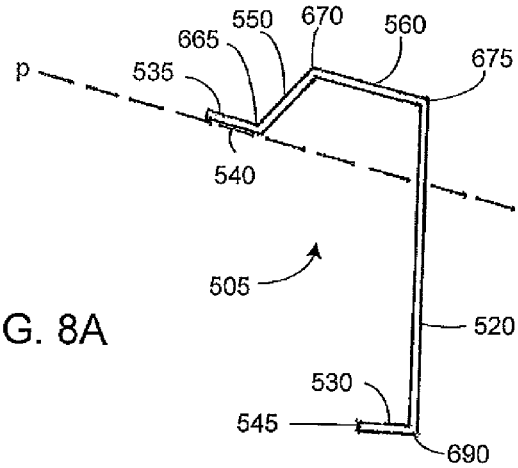
FIG. 8A is a cross-section view of an alternative starter-terminator in accordance with an embodiment of the present disclosure.

FIGS. 7-8A show exemplary embodiments of an integrated light gauge steel starter-terminator 500 of the present disclosure. The integrated starter-terminator 500 can include a hat section 510, a fascia 520, and a soffit return 530. The illustrated starter-terminator 500 can be made of light gauge steel as described above, can have a first end 535 and a second end 545, and can be bent formed with multiple bends that define the hat section 510, the fascia 520, and the soffit return 530. Advantages of the starter-terminator 500 include a single element that combines a fascia 520 and a soffit return 530, and the possible elimination of the blocking between the heels of adjacent trusses.

The hat section 510 can include legs 540, webs 550, and a top 560. A first leg 540 can be defined as the portion of material between the first end 535 and a first bend 665. A first web 550 can be defined as the portion of material between the first bend 665 and a second bend 670. A top 560 can be defined as the portion of material between the second bend 670 and a third bend 675. A second web 550 can be defined as the portion of material between the third bend 675 and a fourth bend 680. A second leg 540 can be defined as the portion of material between the fourth bend 680 and a fifth bend 685. The hat section 510 can be substantially similar to the hat top purlin 100 described above in connection with FIGS. 1 and 2 and can include legs 540 of about three quarters of an inch (¾"), a top 560 of about one and three quarters inches (1¾") in width, and a depth of about one and a half inches (1½"). As seen in FIG. 8, the legs 540 can lie in a plane "p."

A fascia 520 can be defined as the portion of material between a fifth bend 685 and a sixth bend 690. The fascia 520 can be attached to a truss heel 760, as described more fully with regard to FIG. 9. Thus, it is contemplated that the size of the fascia 520 can vary depending upon the size of the truss heel to which it will be attached. In an exemplary embodiment, the fascia 520 is approximately three and thirteen sixteenths inches (3 13/16") in height, and can be taller in order to span materials attached to the bottom chord. The starter-terminator 500 can be made of light gauge steel and can be suitable for hanging a gutter, signage, or other architectural details form the fascia 520.

As best seen in FIG. 8, fifth bend 685 can define an angle $\alpha$ between the hat section 510, for which the plane "p" can be a reference, and the fascia 520 of the integrated starter-terminator 500. The bend 685 can be such that the angle $\alpha$ approximates the angle created by the slope of the truss top cords 210 and the truss heel 760 to which the integrated starter terminator 500 will be attached. Nevertheless, the angle $\alpha$, created by the slope of the bend between the fascia 520 and hat section 510, can be varied depending upon the particular application.

A soffit return 530 can be defined as the portion of material between a sixth bend 690 and a second end 545 of the integrated starter-terminator 500. The soffit return 530 can be used in conjunction with other material extending back to the building structure. For example, a soffit panel can be added, extending from the truss heel back to the building, to cover the overhang between the fascia 520 and the building structure. In the illustrated embodiment the soffit return 530 is about one and three quarter inches (1¾").

The integrated starter-terminator 500 can be attached to the truss as described above with reference to the purlins 100. Thus, the integrated starter terminator 500 can be placed at the truss heel such that the hat section 510 is placed atop the truss top chords 210. As such, separate blocking typically placed between adjacent truss heels can be eliminated, and the function thereof can be performed by the starter-terminator 500. Preferably, the angle between the hat section 510 and the fascia 520 is such that the hat section 510 and the fascia 520 conform to the slope of the top chords 210 and truss heel, respectively, though this is not required. Fasteners, such as the pins 220 shown in FIG. 3 can be used for attaching the hat section 510 to the top chords, and the fascia 520 and the soffit return 530 to the truss. A roof panel can then be attached to the hat section 510 using fasteners, such as the pins 430 used to attach plywood panels 410 in FIG. 6.

FIG. 8A illustrates an alternative starter-terminator 505 that includes many elements similar to those described above with respect to the first illustrated starter-terminator 500. One exemplary reason for making starter-terminators 500, 505 with different configurations, e.g., a different number of bends, is to accommodate various architectural features such as, but not limited to, gutters, awnings, signage, and the like.

The length of the integrated starter-terminators 500, 505 can also be varied depending upon the application. The lengths of the starter-terminators 500, 505 can be slightly longer, such as by a few inches, than the length required to traverse a desired number of truss bays. For example, in an exemplary embodiment wherein the trusses are arranged four feet (4') apart on-center, an integrated starter-terminator 500, 505 can have a length that is a multiple of four feet (4') plus a few inches, such as a length of sixteen feet and six inches (16'6"), where the integrated starter-terminator 500, 505 traverses four (4) bays. Alternatively, the length of the starter-terminator 500, 505 can be twelve feet, six inches (12'6"), wherein the starter terminator 500, 505 traverses three (3) bays. This allows for a portion of the integrated starter-terminator 500, 505 to extend approximately three inches (3") beyond the top chord so that it can be butt-connected with an adjacent integrated starter-terminator 500, 505, such as by a sleeve, and sealed with a caulk bead or other sealant. Alternatively, adjacent sections of the starter-terminators 500, 505 can overlap or an internal splice (not shown) can be provided. In one embodiment, the internal splice is positioned under the joint formed by adjacent sections, and is fastened to span adjacent trusses.

Figure 9:
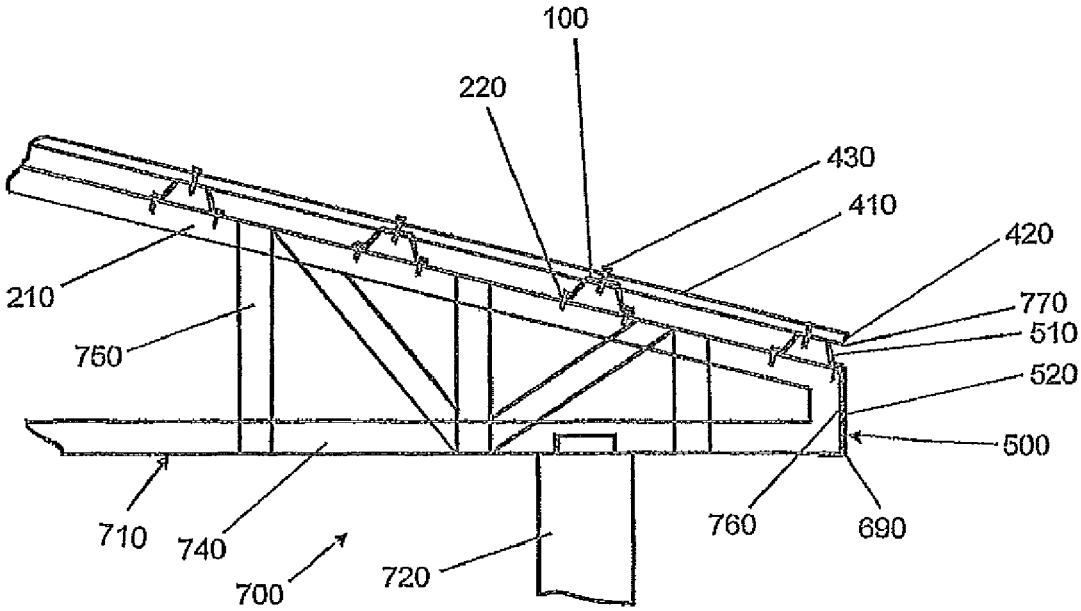
FIG. 9 is a sectional side elevation view of a roofing system in accordance with an embodiment of the present disclosure.
Figure 15:
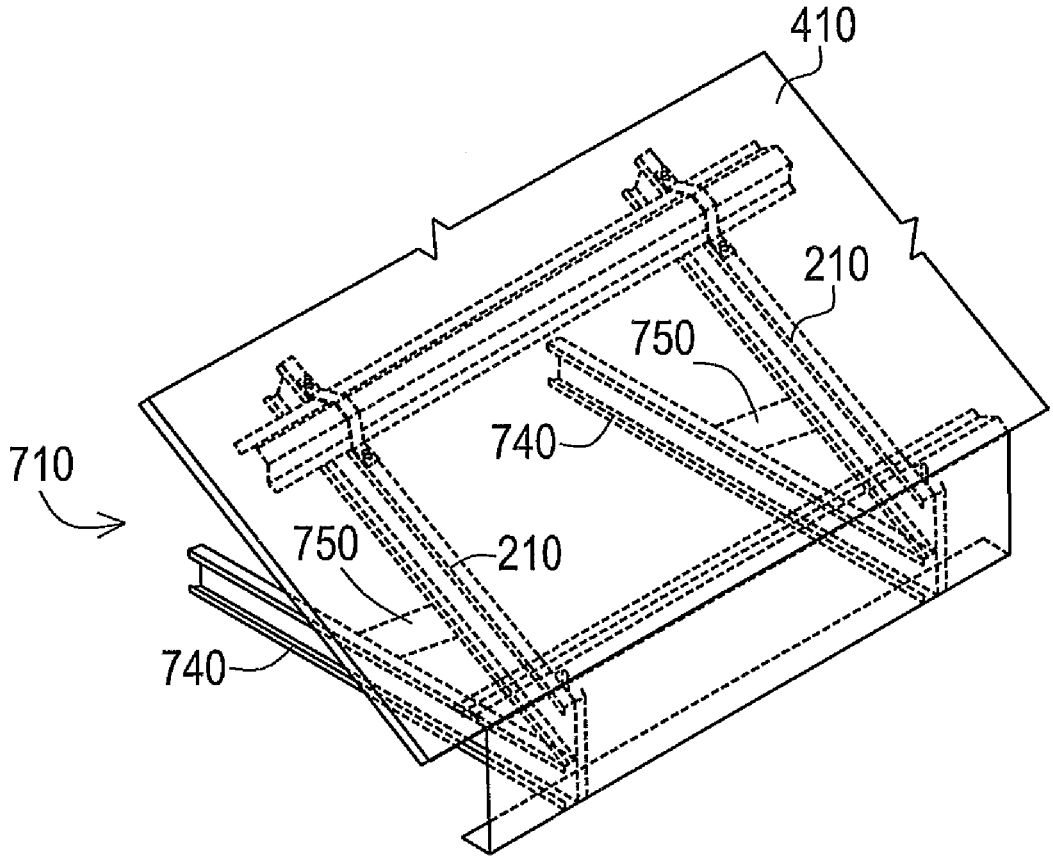

Turning to FIGS. 9 and 15 there is shown an exemplary embodiment of an above the top chord roofing assembly 700. A truss 710 that is supported by a truss bearing member 720 can include a top chord 210, a bottom chord 740, and a plurality of webs 750 supporting the top chord 210 at a desired slope. The truss 710 can be made of light-gauge metal with a minimum truss heel 760 of about three and thirteen sixteenths inches (3 13/16"). Such trusses are available through the Applicant, and can be arranged on four foot centers.

Figure 10:
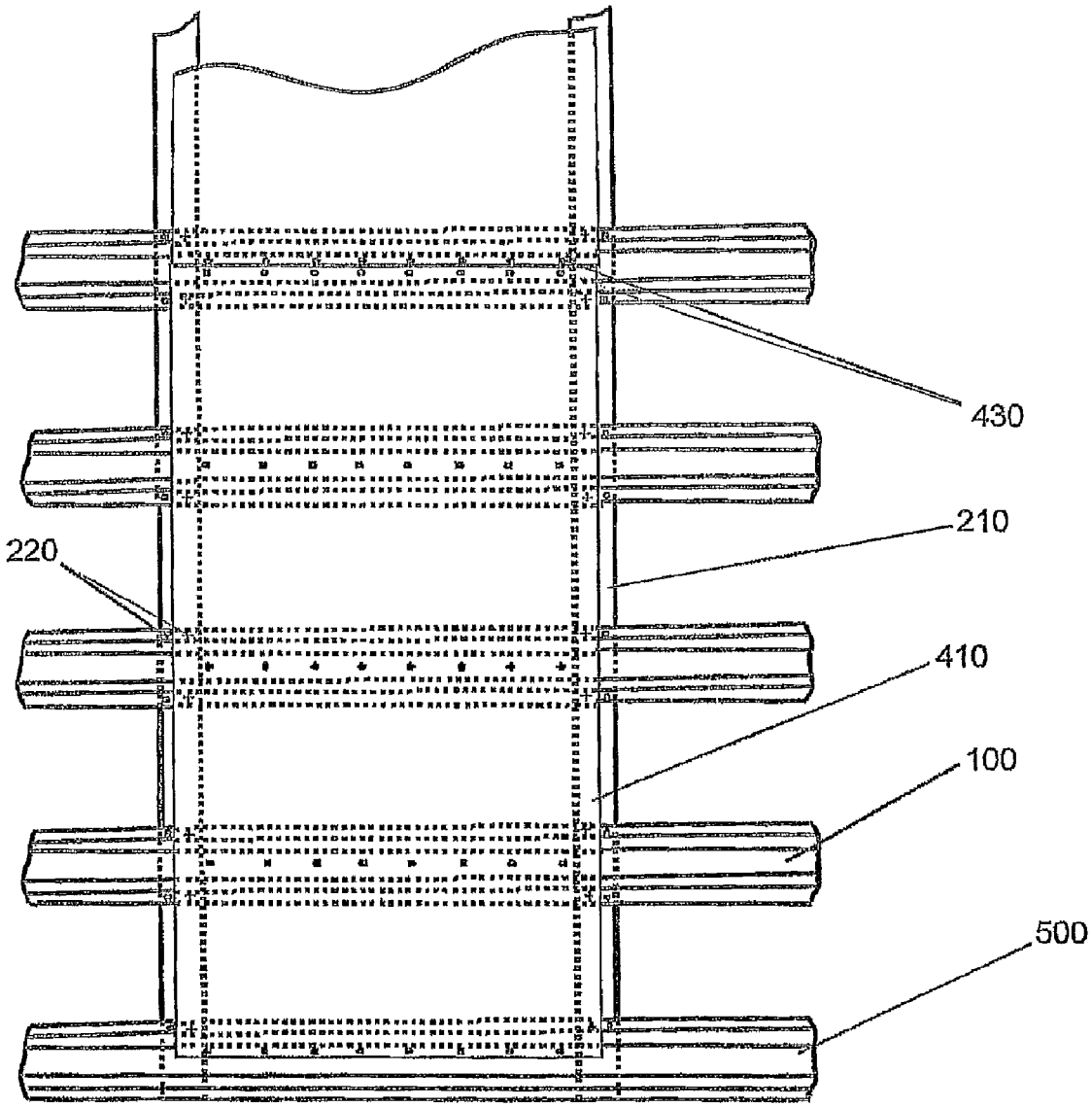
FIG. 10 is a top view of a roofing system in accordance with an embodiment of the present disclosure.
Figure 11:
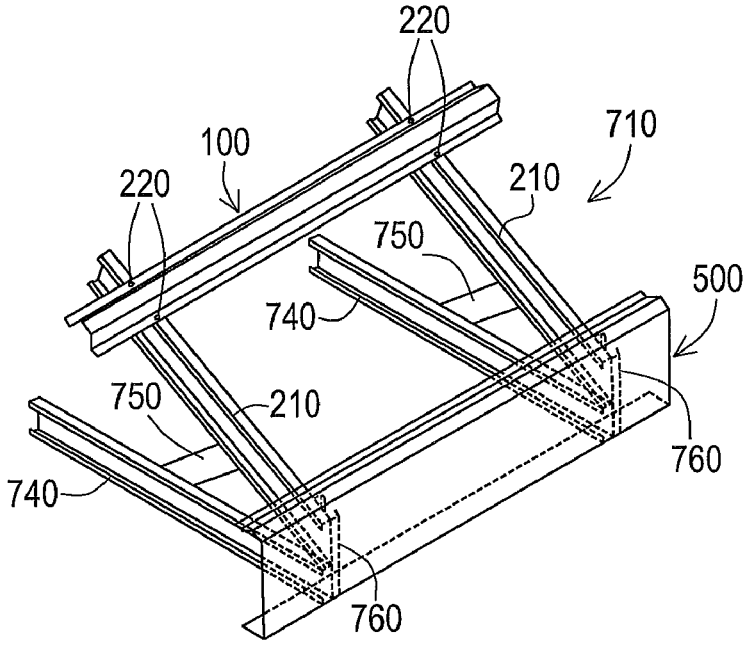
FIGS. 11-15 are perspective views of steps for forming a roofing system in accordance with an embodiment of the present disclosure.

Referring to FIGS. 9-15, the assembly of the above the top chord roofing assembly 700 is described. As best shown in FIGS. 9 and 11, the integrated starter-terminators 500, 505 can be attached at the truss heels 760 of the trusses 710. In an exemplary embodiment, wherein the top chords 210 are arranged forty eight inches (48") apart, on-center, a length of sixteen feet and six inches (16'6") can be used to traverse four (4) bays defined by the spaced apart trusses 710, thus allowing for about three inches (3") of the integrated starter-terminator 500, 505 to extend beyond the top chord 210. Sleeves (not shown) can be attached to integrated starter-terminator fascias 520 so that one or more adjacent integrated starter-terminators 500, 505 can be end butt-connected and sealed with a caulk bead or other sealant. Alternatively, the starter-terminators 500, 505 can be overlapped.

The angle between the hat section 510 and the fascia 520 of an integrated starter-terminator 500, 505 can be equal to the slope of the top chords 210. The height of the fascia 520 can be approximately equal to the truss heel 760 of three and thirteen sixteenths inches (3 13/16"). The integrated starter terminator 500, 505 can be attached using the pin fasteners 220 as described above. Additional materials can be added to the integrated starter-terminator soffit 530 to extend back to the building. The fascia 520 can be attached to the truss heel 760 and further used for hanging a gutter, signage, or other architectural details. Furthermore, the truss can extend beyond the building structure to form an overhang, and a soffit panel (not shown) can be added extending from the truss heel 760 back to the building to cover the overhang. The connection of the starter-terminators 500, 505 to the truss top chord 210, the heel 760, or the bottom chord 740 can be made in the same manner as described above with regard to the connection of the purlin 100 to the truss top chord 210.

Referring to FIGS. 3 and 11, a plurality of top-hat purlins 100 can be fastened to the truss top chords 210 in a parallel spaced apart manner. In an exemplary embodiment in which the trusses are arranged four feet (4') apart, on-center, the purlins 100 and the integrated starter-terminators 500, 505 can be arranged twenty four inches (24") apart, on center, in a direction substantially perpendicular to the direction of the top chords 210. As discussed above, the pin fasteners 220 can be used with an auto-nailer to fasten the purlins 100 to the top chords 210 through the legs 130.

Figure 12:
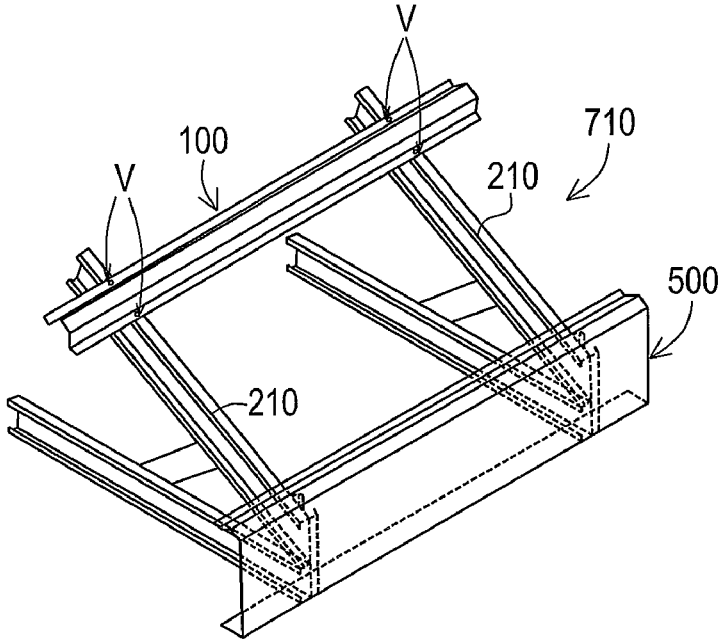
Figure 13:
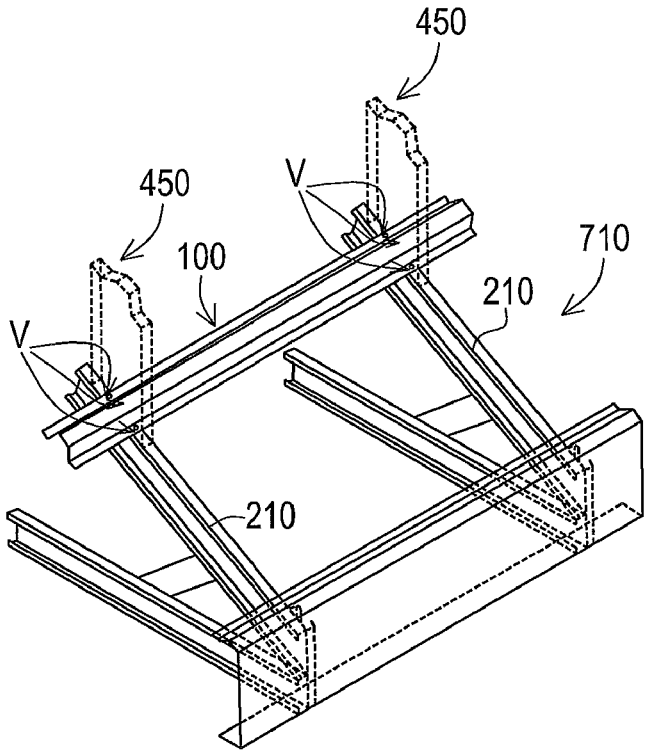
Figure 14:
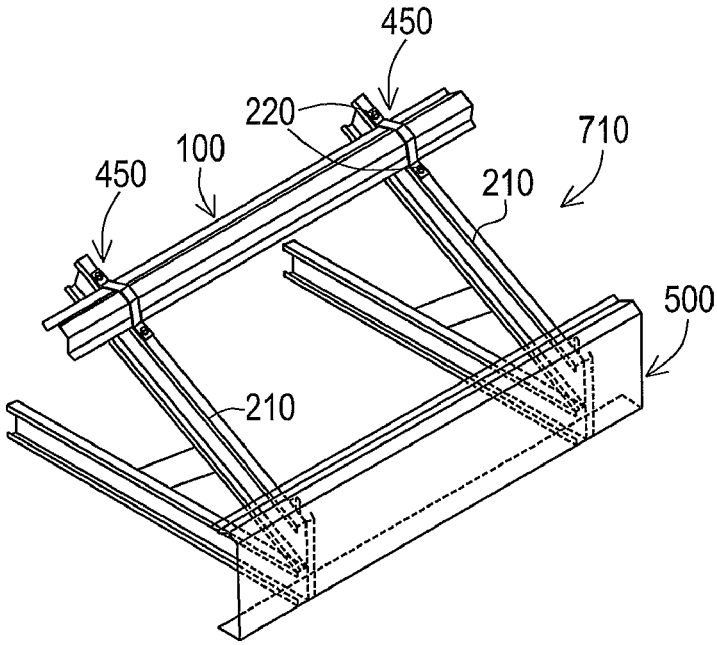

Referring to FIGS. 5 and 12, an adhesive can be applied to areas V of the top chords 210 where the legs 480 of the purlin collars 450 will be positioned. Additionally, or in the alternative, an adhesive can be applied to areas V of the tops 110 of the purlins 100 where the tops 460 of the purlin collars 450 will be positioned. Referring to FIGS. 5 and 13, the purlin collars 450 can be positioned with respect to the purlins 100 and the truss top chords 210 such that the adhesive provides a connection between the legs 480 and the top chords 210, and between the tops 460 and the tops 110. Referring to FIGS. 5 and 14, as discussed above, the pin fasteners 220 can be used with an auto-nailer to fasten the purlin collars 450 to the top chords 210 through the legs 480.

As best shown in FIGS. 6, 9, 10 and 15, a plurality of roofing panels 410 can be fastened to the top of the purlins 100 and the integrated starter-terminators 500, 505. The pin fasteners 430, as discussed above in reference to FIG. 6, can be used with an auto-nailer. In an exemplary embodiment in which the purlins 100 are arranged twenty four inches (24") apart, on-center, four feet wide by eight feet long, by three quarters of an inch (4'×8'×¾") thick plywood panels can be used. The first run of the plywood can be started at the integrated starter-terminator 500, 505. As shown in FIG. 9, the first plywood panel 410 can be run down so that its edge 420 is flush with the fascia 520 of the integrated starter-terminator 500, 505. This arrangement can provide a first drip edge 770 for allowing water to drip down from the roof panel 410 to the fascia 520, and a second drip edge at the fascia 520 by a sixth bend 690.

As shown in an exemplary embodiment in FIG. 10, the roof panels 410 can be spaced and placed atop the purlins 100. In an embodiment in which the purlin top 110 is one and three quarters inches (1¾") wide there is sufficient edge distance, preferably a three eighths of an inch (⅜") minimum edge distance, from the centerline to the fastener so that nails can be shot down on both panels 410 so as to provide suitable bearing for the roof panels while maintaining the integrity of the panels 410. Panel materials other than structural plywood or OSB panels can be used. For example, Homasote® and Nyloboard® brand panels are contemplated. Use of other panel materials may require different purlin top dimensions. A six inch (6") apart on center nail pattern can be used for a one hundred twenty (120) miles per hour wind-resistant application.

As shown in FIG. 10, an advantage of the present disclosure is that fasteners are not required along the full length of the edges of the structural panels 410. However, H clips (not shown) can also be provided between adjacent panel edges to prevent deflection. As discussed above with respect to FIG. 4, an exemplary heat treated ballistic point steel pins 430 having a length of about one and three eighths inches (1⅜"), a head with a diameter of about one quarter of an inch (¼"), a shank diameter of about one tenth of an inch (0.100"), and having a grip knurl, can be used. A roofing system using these components and assembled in the manner taught herein can be suitable for winds in excess of 130 mph.

An exemplary method of assembling a roof system to erected roof trusses, according to the present disclosure, includes installing a starter-terminator 500, 505 as described herein. After a sufficient length of starter-terminator 500, 505 is attached, measuring from the first end 535 of the inside leg 540 to a position on the upper face of the top chord to identify where the edge of the facing leg 130 of the first row of the purlins 100 can be placed. After installing a sufficient length of the purlins 100, as described herein, and installing the purlin collars 450, as described herein for those embodiments that include the purlin collars 450, installing a first row or section thereof of the structural panels 410, as described herein. With a sufficient area of the first row structural panels 410 attached, as described herein, the installers have a surface area by which they can safely install successive rows of the purlins 100, the purlin collars 450, and the structural panels 450, moving upwardly toward the roof peak until the exemplary system is installed. With the installation of at least a first section of a starter-terminator 500, 505, at least a first section of the purlins 100, and at least a first section of the structural panels 410, the installers can alternately install sections of the purlins 100 and then sections of the structural panels 410.

The present disclosure has been illustrated in relation to various particular embodiments, which is intended in all respects to be illustrative rather than restrictive. For example, as used herein, directional references such as "horizontal" and "vertical" do not limit the respective elements to such orientation, but merely serve to distinguish these elements from one another for ease of description.

It will be emphasized that the law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations can be made to the above-described embodiments without departing from the scope of the claims. All such variations, modifications, and combinations are included herein by the scope this disclosure and the following claims.

What is claimed is:

1. A roofing system, comprising:

a truss comprising a top chord and oriented in a first direction;

a purlin comprising:

a purlin top configured to have a roof panel attached thereto;

purlin legs configured to be attached to the truss; and purlin webs connecting the purlin top and the purlin legs, the purlin oriented in a second direction that is substantially perpendicular to the first direction, the legs being in contact with and fastened to the top chord; and a purlin collar comprising:

a collar top configured to contact the purlin top;

collar legs configured to be attached to the truss; and collar webs connecting the collar top and the collar legs, the purlin collar being placed over a section of the purlin such that the collar top is in contact with the purlin top and the collar legs are in contact with the top chord outside the purlin legs, the collar legs being fastened to the top chord.

2. The roofing system of claim 1, further comprising a roof panel fastened to the purlin top with mechanical fasteners.

3. The roofing system of claim 2, wherein the roof panel is fastened to the collar top with mechanical fasteners.

4. The roofing system of claim 1, wherein the collar legs are fastened to the top chord with at least one of adhesive and mechanical fasteners.

5. The roofing system of claim 4, wherein the purlin legs are fastened to the top chord with mechanical fasteners.

6. The roofing system of claim 1, wherein the collar top is fastened to the purlin top with at least one of adhesive and mechanical fasteners.

7. The roofing system of claim 1, the purlin webs being configured at a first angle with respect to one another and the collar webs being configured at a second angle with respect to one another, the second angle being greater than the first angle.

* * * * *